United States Patent [19]

Willetts

[11] Patent Number: 4,600,179

[45] Date of Patent: Jul. 15, 1986

[54] MODULE FOR FORMING A BARRIER AND METHOD OF ASSEMBLY

[75] Inventor: Charles A. Willetts, Wollaston, England

[73] Assignee: Allied Tube & Conduit Corporation, Harvey, Ill.

[21] Appl. No.: 723,741

[22] Filed: Apr. 16, 1985

[51] Int. Cl.[4] ..... E04H 17/14

[52] U.S. Cl. ..... 256/67; 256/22

[58] Field of Search ..... 256/65, 67, 68, 69, 256/21, 22

[56] References Cited

U.S. PATENT DOCUMENTS

| | | | |
|---|---|---|---|
| 764,468 | 7/1904 | Hohulin et al. . | |
| 1,791,680 | 2/1931 | Miller . | |
| 3,266,051 | 8/1966 | Attwood | 52/100 |
| 3,484,931 | 12/1969 | Lindesmith et al. | 29/516 |
| 3,580,122 | 5/1971 | Powell | 83/108 |
| 4,101,226 | 7/1978 | Parisien | 403/4 |
| 4,421,302 | 12/1983 | Grimm | 256/67 |
| 4,466,600 | 8/1984 | Tuttle | 256/65 |

*Primary Examiner*—Andrew V. Kundrat

*Attorney, Agent, or Firm*—Fitch, Even, Tabin & Flannery

[57] ABSTRACT

A module for use in forming a barrier such as a fence. The module includes a pair of aligned tubular rails having facing inside walls with a plurality of spaced apertures therealong and with respective apertures in each inside wall corresponding to one another and forming pairs. A bushing formed of a resilient material lines each of the apertures. The module further includes a plurality of spaced metallic rungs extending between the rails with each rung having end portions received by a respective pair of the apertures in the inside walls so that the rung end portions extend inside the respective rails. A retainer is held in each rail end portion and it includes an abutment wall positioned for bearing on one of the rung end portions and an attachment wall positioned adjacent the rail end. A method of assembly of the module is also set forth.

14 Claims, 13 Drawing Figures

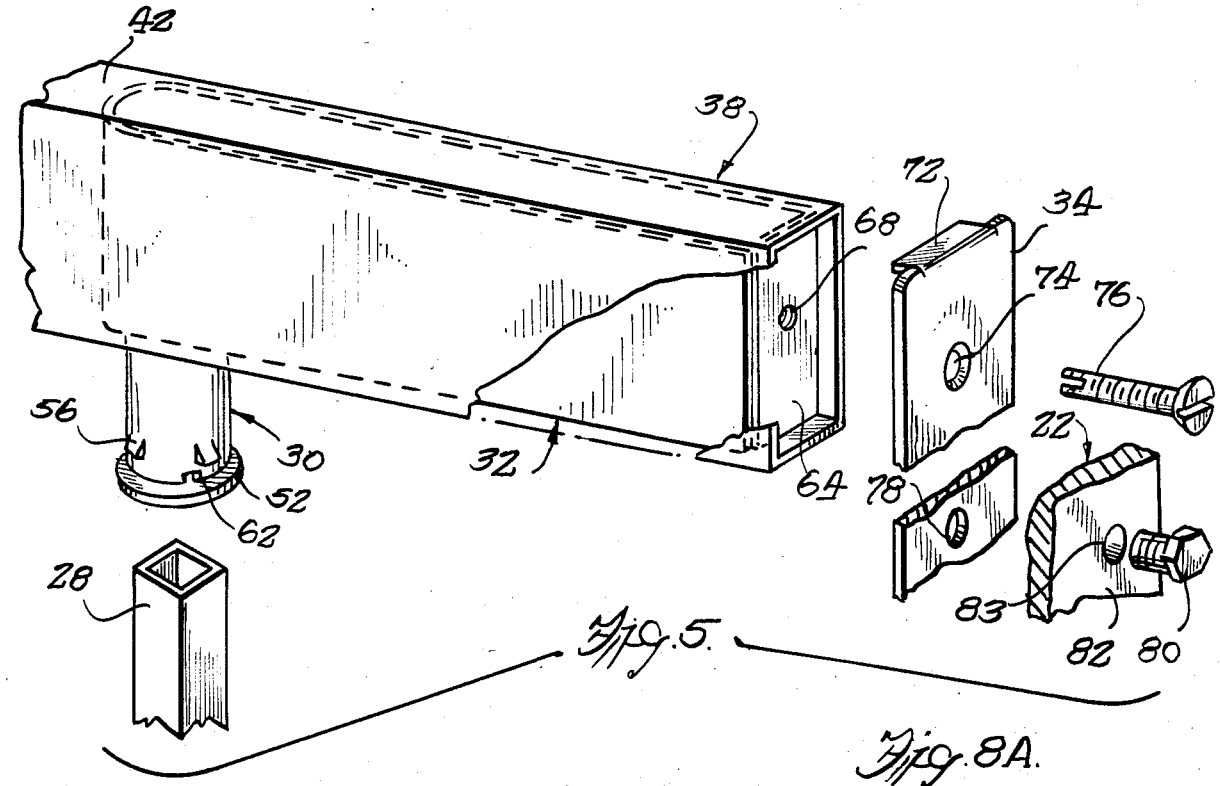
Fig. 5.
Fig. 6.
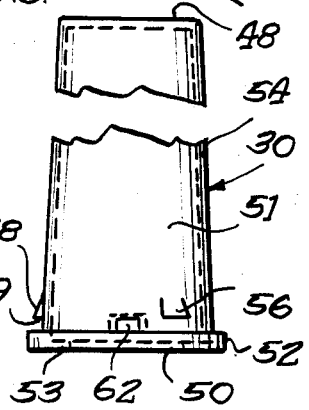
Fig. 7.
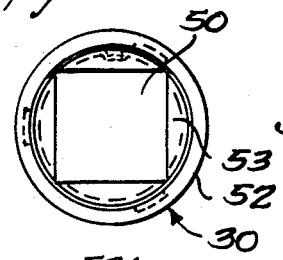
Fig. 8A.
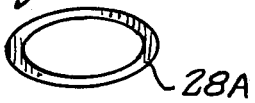
Fig. 8B.
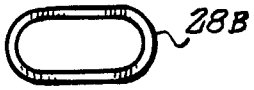
Fig. 7A.
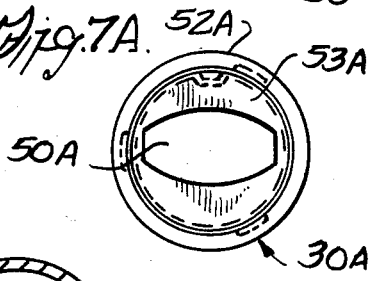
Fig. 8C
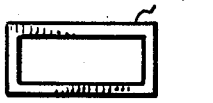
Fig. 9.
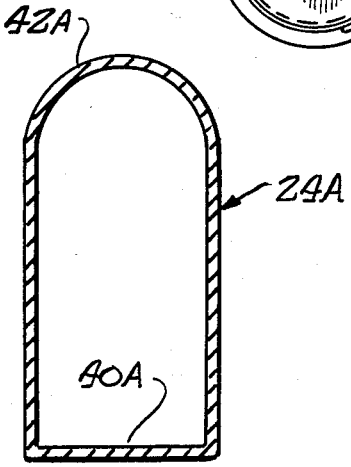
Fig. 8D.
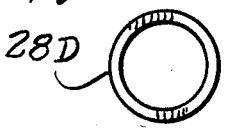

MODULE FOR FORMING A BARRIER AND METHOD OF ASSEMBLY

The present invention relates to barriers and, more specifically, to an easily assembled module for forming a barrier, such as a fence or a balustrade.

BACKGROUND OF THE INVENTION

Barriers, such as fences, balustrades and banisters, typically require labor intensive assembly and may require the use of several tools. Furthermore such barriers, when used outdoors, require extensive and frequent application of coating material. If not adequately protected, wood fences rot and steel barriers rust.

An example of such a barrier is a welded steel picket fence. After the vertical support posts are set, the upper and lower horizontal cross members are installed. Next each individual picket is attached by welding to the cross members. Care must be exercised in properly locating each picket and a coating for corrosion protection is applied after assembly is completed.

In one proposed semi-modular grillwork assembly, upper and lower rails have apertures for receiving the end portions of verticals. Each end portion in turn has an aperture for receiving a horizontally extending rod insertable in each rail. Horizontal compression plates fit into slots in the upper and lower rails to bear against the ends of the verticals thereby holding the assembled components. For further information regarding the structure and operation of this grillwork, reference may be made to U.S. Pat. No. 1,791,680.

SUMMARY OF THE INVENTION

Among the several aspects of the present invention may be noted the provision of an improved module for use in forming a barrier. The module can be assembled quickly and easily using only a simple hand tool, such as a screwdriver. The components are light in weight and can be shipped from the site of manufacture in knock-down form using simple packaging so that the components can conveniently be handled by the consumer. The assembled module offers long service life because the possibility of the entrance of water into the interior of tubular metallic components is reduced. The module offers great flexibility and variation because the user can select a number of possible locations for placing rungs and a number of different rung configurations are usable with a common set of upper and lower rails. The components of the module are also easily and economically manufactured. Other aspects and features of the present invention will be, in part, apparent and, in part, pointed out hereinafter in the following specification and accompanying claims and drawings.

Briefly, the module of the present invention includes a pair of aligned metallic tubular rails each having a facing inside wall with each inside wall having a number of spaced apertures therealong with respective apertures in each inside wall corresponding to one another and forming pairs. A bushing formed of thermoplastic material lines each aperture, and spaced metallic rungs extend between the rails with each rung having end portions received by a respective pair of the apertures. A retainer is positioned in each rail end portion and includes an abutment wall positioned engaging one of the rung end portions and an attachment wall located adjacent the rail end for attachment to an end strip covering the rail ends.

BRIEF DESCRIPTION OF THE DRAWINGS

FIG. 5 is an exploded perspective view, with certain components only partially shown, illustrating assembly of the end rung, bushing, upper rail, retainer and end plate;

FIGS. 6 and 7 are side elevational and bottom views, respectively, of the bushing of FIG. 2;

FIG. 7A, similar to FIG. 7, illustrates an alternative embodiment of the bushing;

FIGS. 8A–8D show alternative rung cross-sectional configurations; and

FIG. 9 is a cross-sectional view illustrating an alternative embodiment of the top rail of the present invention which has a "D" or mailbox configuration with an arcuate ceiling to shed precipitation;

Corresponding reference characters indicate corresponding components throughout the several views of the drawings.

DETAILED DESCRIPTION OF THE PREFERRED EMBODIMENTS

Figure 1:
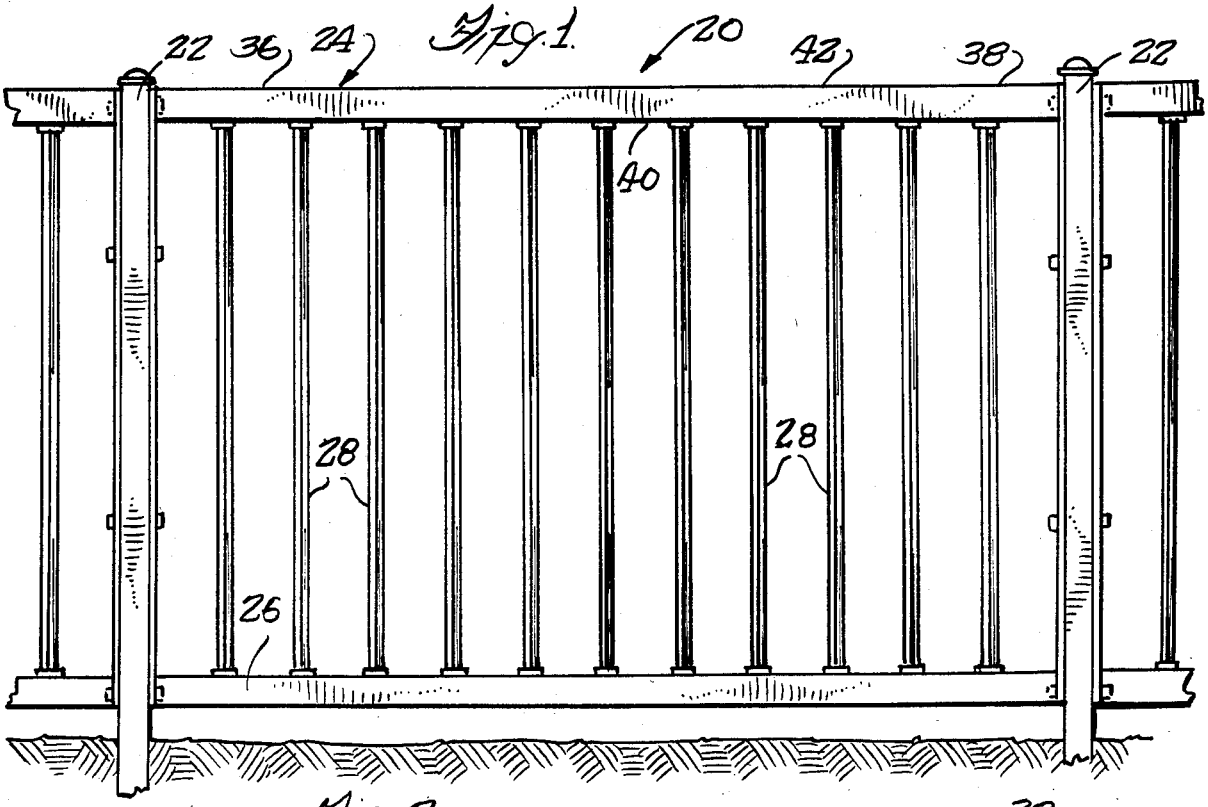
FIG. 1 is a front elevational view of one preferred embodiment of a modular fence assembly embodying various features of the present invention, showing modules having their facing ends mounted on support posts.
Figure 2:
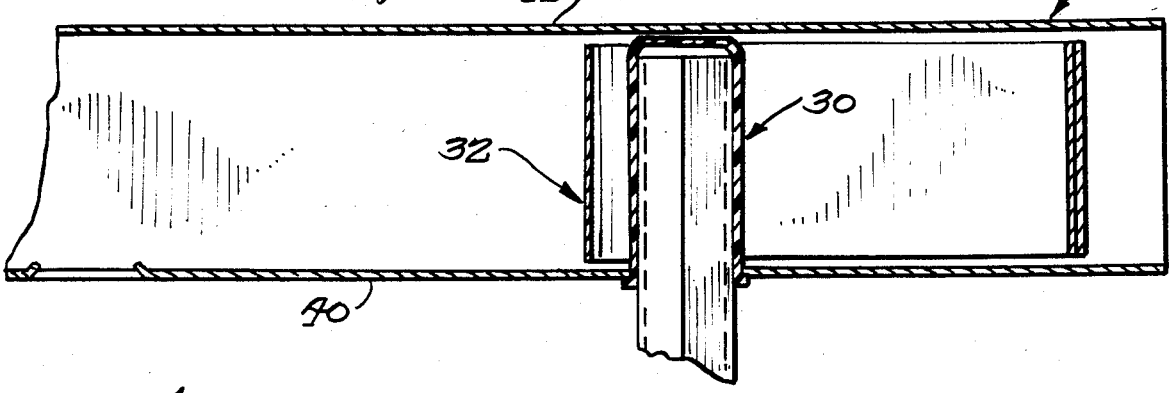
FIG. 2 is a vertical sectional view enlarged in size showing an end portion of an upper rail of one fence module receiving the top portion of an end rung which is jacketed by a bushing.

Referring now to the drawings, a module for use in forming a barrier, such as a fence, balustrade or banister, is generally indicated in FIG. 1 by reference numeral 20. The module is adapted to be mounted on vertical support posts 22 and includes only five discrete types of components (not counting threaded fasteners): upper and lower tubular metallic rails 24 and 26, metallic rungs 28 held by the rails and extending vertically therebetween, resilient thermoplastic bushings 30 jacketing the ends of the rungs, metallic retainers 32 (best shown in FIGS. 2, 4 and 5) positioned in each rail end and held captive by the rung disposed adjacent that rail end, and end strips 34 attached to the retainers 32 and adapted for attachment to the support posts 22.

Figure 3:
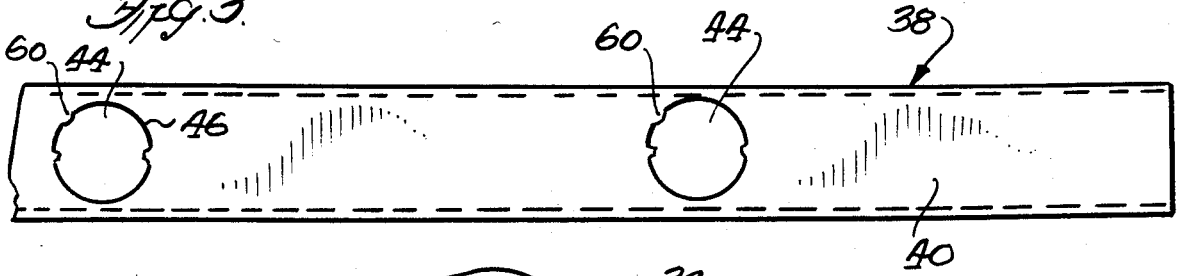
FIG. 3 is a bottom view of the end portion of the upper rail of FIG. 2 illustrating knockouts in the bottom or inside wall thereof so that rungs can be mounted at preselected locations in the rail.

More specifically, the upper and lower rails 24 and 26 are preferably formed on a continuous roll forming mill and have a rectangular cross section. As both are identical only upper rail 24 need be described in detail. The upper rail 24 has a first end portion 36, a second end portion 38, an inside wall 40 facing the lower rail 26 and an outside or upper wall 42. The inside wall 40 has a plurality of knockouts 44 regularly spaced therealong as shown in FIG. 3. Of course removal of a knockout, by applying a sharp blow to it, results in formation of an aperture 46 for receiving the brushing to locate one of the rungs. The knockouts preferably so completely fill their apertures that moisture cannot pass. For information regarding the structure and operation of a mill for forming tubing having such knockouts, reference may be made to commonly assigned U.S. patent application Ser. No. 599,490, filed Apr. 12, 1984. Because the apertures 46 are defined but filled by the knockouts, only the apertures that actually will be used need be opened. Furthermore, the assembler need not decide which apertures to open until the assembly process starts. The outside surfaces of the rails and rungs are protected from corrosion by being galvanized and/or having a decorative or other protective coating applied. This coating also serves to further fill any minute cracks remaining about the knockouts. Additionally, a protective coating could be applied to the inside surfaces of the rails and rungs.

Referring to FIGS. 6 and 7, the bushings 30, preferably formed by injection molding of thermoplastic material such as polypropylene, are employed to line each aperture. Each bushing is generally cylindrical and has a closed end 48 for disposition adjacent the rail outside wall, an open end 50 for a central bore 51 for receiving a rung and a peripheral lip 52 for bearing against the rail inside wall 40 to limit insertion of the bushing through the aperture 46 receiving it. The bushing also has an inner seal 53 at its open end 50 for an interference fit with a rung to assist in holding of the rung and to cause the bushing to press against the inner wall to better seal against the entrance of moisture. The seal 53, which forms a constricted throat for bore 51, has an opening having the same shape as the cross section of the rung. The sidewall 54 of the bushing preferably tapers inwardly from the open end 50 so that the end rung preferably deforms the bushing at the end of its insertion to tightly hold the rung and seal its aperture to block any entrance of water inside the rail.

Each bushing also includes detent means for retaining the bushing in its aperture before the rung is inserted. The detent means includes a plurality of peripheral outwardly extending teeth 56 spaced from the lip 52 a distance about equal to the thickness of the rail inside wall 40. Each tooth has a ramp surface 58 facing away from the lip and an abutment surface 59 facing the lip. Insertion of the bushing causes the material of the inside rail wall 40 defining the aperture 46 to engage the ramp surface 58 causing the tooth 56 and the adjacent portion of the sidewall to deflect inwardly. Upon passing the inside wall, the tooth returns toward its undeflected position so that the abutment surface 59 overlies the inner wall to prevent the inserted bushing from falling out of the rail.

The module 20 also includes anti-rotation means for preventing rotation of the bushing 30 with respect to the inner wall. A protuberance 60 extends from the surrounding inside wall material into the aperture 46. The sidewall 54 of the bushing has formed therein a registration indentation 62 or pocket for receiving the protuberance. When the bushing 30 is fully seated with the protuberance extending into the indentation, rotation of the bushing is prevented. This is particularly advantageous when rungs having non-circular cross sections are employed, for once the module is assembled with the rungs in a common orientation, they cannot later rotate to present a disorganized appearance.

Figure 4:
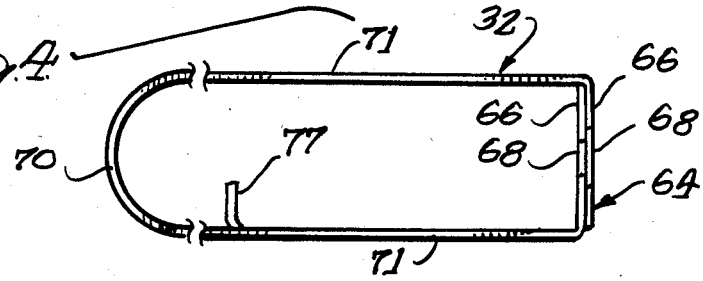
FIG. 4 is a plan view of a retainer which is held captive by the end rung shown in FIG. 2 to permit attachment of an end plate.

As shown in FIGS. 4 and 5, each retainer 32 is preferably formed from a flat blank of spring steel with the ends 66 bent into adjacent, overlapping relationship to form an attachment wall 64, with each end having an aligned hole 68 for receiving a self-tapping screw 76. A bight is formed at the opposite end of the retainer to form an abutment wall 70 for engaging the bushing that receives the rung closest a rail end. The remainder of the blank (sides 71) constitutes interconnection means for these two walls which are spaced apart a distance slightly less than the spacing between the rail end and the aperture (the part of the aperture furthest from the rail end) receiving the bushing. This arrangement allows the retainer 32 to be under some tension when the module is completed so that the various components are held tightly.

The end strips 34 have a length at least as great as that of the rungs. The end of each strip is provided with an inwardly extending locating finger 72 for reception in the rail 24 so it lies against the inside surface of the outside wall 42, and a countersunk hole 74 for receiving the self-tapping screw 76 to attach the strip to the rail via the aligned holes 68 in the retainer attachment wall 64. Each strip is at least about as wide as the ends of the rails and has a corrosion resistant coating; it contains additional holes 78 along its length for receiving threaded fasteners 80 to mount the assembled module 20 to the vertical support posts 22. A caulking compound can be applied around each rail end after its attachment to the end strip 34 to further guard against the entrance of water inside the rails.

Various methods can be employed to allow threading of the self-tapping screw 76 into the aligned holes 68 in the retainer attachment wall 64 without the retainer being pushed farther inside the rail. The sides 71 of the retainer 32 can be spaced so that the bushing is received in an interference fit. That is, as the bushing moves to its fully inserted position, its tapered sidewall deflects the sides 71 apart to hold the retainer against withdrawal as the screw 76 is threaded. As shown in FIG. 4, a tang 77, struck from a side 71 and extending inwardly, can be provided to bear against the bushing to permit threading of the screw 76. Furthermore, the locating finger 72 can be configured to have sufficient length to extend over the top of the retainer attachment wall 64 and push it against the inside rail wall 40 to restrain movement of the retainer.

As shown in FIG. 5, the rungs 28 have a square cross section and, as shown in FIG. 7, the bushing 30 has an entrance seal 53 having a generally square opening for receiving the rung sidewall in an interference fit to prevent the entrance of water inside the tubular rung. As the bushing is closed by the end 48, should any moisture enter past the seal 53, it cannot gain access to the inside of the rail 24. Additional rung cross-sectional configurations 28A–28D are shown in FIGS. 8A–8D, respectively, wherein the rung could be elliptical, oval, rectangular or circular. Bushings used with these alternative rung configurations are provided with entrance seals having openings shaped to match the rung cross-section and sized to receive the rung end in an interference fit to establish a seal to block the entrance of moisture inside the rung. For example, FIG. 7A shows a bushing 30A having a seal 53A with an elliptical opening for receiving the rung 28A. It will be noted that the outside surface configuration of the bushing remains constant without regard to the shape of the seal and the rung. As the apertures 46 in the rail can always have the same configuration (circular) the same rails can be used with all the different rung shapes. An alternative way of providing the rung sealing function in the bushing is to configure the inner surface of the bushing defining the bore 51 in accordance with the rung cross section. As this inner surface tapers inwardly toward the closed end 48, further insertion of the rung would cause the rung to be tightly held with a seal formed at the end of the rung.

As shown in FIG. 5, the support post 22, which is preferably rectangular in cross section, has flat sides 82 facing the end strips 34 of the two modules it supports to permit flush mounting. Each post 22 has spaced holes 83 along its length for alignment with corresponding strip mounting holes 78 and fasteners 80 in the form of bolts or screws can be used for attachment of the modules to the support posts.

An alternative embodiment of the upper rail is shown in FIG. 9, denoted by reference character 24A. The alternative configuration includes an outside wall 42A which is convex or arched to shed moisture.

The module 20 of the present invention is assembled as follows:

(a) The user determines which of the knockouts 44 in the upper and lower rails to remove so that one aperture 46 in each rail can be aligned with and forms a pair with an aperture in the other rail to receive one of the rungs 28.

(b) A retainer 32 is placed in each end of each rail so that the end aperture is disposed between the abutment wall 70 and the attachment wall 64 of the retainer.

(c) A bushing 30 is inserted into each of the apertures 46, as described above, to provide a lining for each aperture in both rails.

(d) The ends of the rungs 28 are inserted into all of the bushings installed in one of the rails.

(e) The other rail is aligned so that the remaining ends of the rungs 28 can be received in the bushings 30 held by that rail.

(f) One of the end strips 34 is positioned to overlie the first ends 36 of the respective rails so that the strip holes 74 are aligned with the attachment holes 68. This allows the self-tapping screw 76 to be threaded into the attachment wall, and by tightening the screw with a simple hand tool, i.e., a screwdriver, the retainer 32 is drawn toward the end strip to tension and tighten the assembly at the components of the module 20.

(g) The last-mentioned step is repeated with respect to the remaining end strip which is attached to the retainers held in the opposite ends 38 of the rails.

It will be appreciated that the module 20, with its knockdown nature, is particularly conducive for sale to the consumer in kit form. Each kit includes the upper and lower rails 24 and 26, a number of rungs 28, the necessary bushings 30, four retainers 32 and two end strips 34. Because the components are typically generally flat pieces, they can be packaged using simple cartons. Furthermore, as the rungs 28 and rails 24 and 26 are tubular, they provide high strength with relatively low weight. It will also be appreciated that because the modular assembly can be easily disassembled great variety is provided. If the consumer wishes to have a different rung configuration, it is a simple matter to replace the rungs with rungs having a different configuration. The module offers a great degree of corrosion protection because the interiors of the tubular parts are effectively sealed from the entrance of moisture which could cause rusting. Fencing assembled from modules 20 can be used in very active corrosion areas and still display long service life.

Although the rails 24 and 26 are shown horizontally disposed, they can be positioned angled with the rungs situated vertically. Thus, the module 20 can be used for making a banister for a flight of stairs. The bushings 30 offer sufficient elasticity that the rungs can extend other than perpendicular to the rails without bending any of the metal components.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. A module for use in forming a barrier and having first and second ends adapted for attachment to spaced supports, said module comprising:

a pair of aligned metallic tubular rails having facing inside walls and each having first and second end portions, each inside wall having a plurality of spaced apertures therealong with respective apertures in each inside wall corresponding to each other and forming pairs;

a bushing formed of resilient material lining each of said apertures;

a plurality of spaced metallic rungs extending between said rails with each rung having end portions received by a respective pair of apertures in said inside walls so that the rung end portions extend inside the respective tubular rails; and a retainer received in each rail end portion and including an abutment wall portion in association with one of said rung end portions, an attachment wall portion lying adjacent the rail end so that said rung end portion is disposed between the abutment wall and the attachment wall, and means interconnecting said abutment and attachment wall portions.

2. A module as set forth in claim 1 further comprising an end strip at each end of said module and adapted for attachment to one of said supports, each strip closing corresponding ends of said rails and being attached to attachment walls of corresponding retainers.

3. A module as set forth in claim 1 wherein one of said rails is an upper rail and includes an outside wall spaced from its inside wall, each bushing associated with said upper rail having a closed end disposed adjacent said outer wall and an open end carrying a lip for bearing against said inside wall to limit insertion of the bushing through the aperture receiving it.

4. A module as set forth in claim 3 wherein each bushing associated with said upper rail includes deflectable, outwardly extending detent means spaced from said lip a distance substantially equal to the thickness of one of said inside walls.

5. A module as set forth in claim 4 wherein said detent means comprises a tooth having a ramp surface facing away from said lip and an abutment surface facing said lip, insertion of said bushing causing the material of said inside wall defining the aperture receiving the bushing to engage said ramp surface causing said tooth to deflect inwardly, upon passing said inside wall said tooth returning toward its undeflected position so that said abutment surface overlies said inner wall.

6. A module as set forth in claim 3 wherein at least one of said apertures is generally circular and its corresponding bushing is generally cylindrical, said module including anti-rotation means for preventing rotation of said bushing after location in its aperture.

7. A module as set forth in claim 1 wherein said retainer is formed from a metallic blank, said attachment wall comprising overlapping ends of said blank with each end having an aligned hole for receiving a fastener.

8. A module as set forth in claim 7 wherein said abutment wall of said retainer comprises a bight at the opposite end of said retainer from said overlapping ends.

9. A module as set forth in claim 1 wherein each of said apertures is generally circular and each of said bushings is substantially cylindrical, at least one of said rungs having a non-cylindrical cross-sectional configuration sized for reception in one of said bushings in an interference fit, the bushing corresponding to the last-mentioned rung having an outside surface configuration similar to that of said aperture and an inside seal configuration similar to that of its corresponding rung.

10. A module as set forth in claim 3 wherein said outside wall of said upper rail is convex.

11. A modular barrier comprising:

a pair of metallic tubular rails each having first and second ends and a wall with regularly spaced defined but sealed apertures;

a plurality of bushings formed of resilient material for lining ones of said apertures;

a plurality of substantially identical rungs having end portions sized for reception in said bushings;

four metallic retainers sized for reception in the ends of said rails, each retainer including an abutment wall and an attachment wall and means interconnecting the last-mentioned walls, the spacing between said abutment wall and said attachment wall being less than the spacing between the aperture adjacent a rail end and that rail end; and a pair of end strips each having a length at least as great as that of said rungs and adapted for attachment to the attachment walls of two of said retainers.

12. A module as set forth in claim 11 wherein each of said apertures is filled by a knockout.

13. A method of making a modular barrier comprising the steps of:

(a) placing a retainer in each end of a pair of metallic tubular rails each having first and second ends and a wall with apertures therealong, each retainer including an abutment wall and an attachment wall having a hole and spaced from said abutment wall a distance less than the spacing between the aperture adjacent a rail end and that rail end, each retainer being placed so that the aperture adjacent the rail end is disposed between the walls;

(b) lining each of said apertures with a bushing formed of resilient material;

(c) inserting the end portions of a plurality of substantially identical rungs in respective bushings so that said rungs extend between said rails;

(d) covering the first ends of said pair of rails with one of a pair of end strips, each strip having a length at least as great as that of said rungs and a pair of holes alignable with holes in the abutment walls in two of said retainers;

(e) drawing the two retainers held in the rail first ends toward said one strip through the use of tightenable fastening means extending through the respective holes in said one strip and the two retainers; and (f) covering the second ends of said pair of rails with the other of said strips so the holes of that strip are aligned with their corresponding retainer attachment wall holes and drawing the corresponding retainers toward said other strip using tightenable fastening means.

14. A method as set forth in claim 13 wherein the apertures of said rails are filled by knockouts and said method further comprises the step of removing selected ones of said knockouts.

* * * * *